US007175147B1

(12) United States Patent
Marks et al.

(10) Patent No.: US 7,175,147 B1
(45) Date of Patent: Feb. 13, 2007

(54) STOPPER HOLDER FOR BEVERAGE BOTTLE

(76) Inventors: Matthew Marks, 830 Golf Club Cir., Pleasant Hill, CA (US) 94523; Cris Alegria, 6121 Elkhorn Ct., Vallejo, CA (US) 94591

( * ) Notice: Subject to any disclaimer, the term of this patent is extended or adjusted under 35 U.S.C. 154(b) by 236 days.

(21) Appl. No.: 10/833,208

(22) Filed: Apr. 26, 2004

(51) Int. Cl.
*A47H 1/16* (2006.01)

(52) U.S. Cl. ..... 248/303; 248/687; 248/312; 248/302; 215/390; 211/74; 446/489

(58) Field of Classification Search ..... 248/213, 248/682, 687, 51, 312, 692, 303, 302, 37.3, 248/37.6, 107, 315, 316.8, 108; 215/390, 215/386, 400, 306, 299; 211/74; 446/489
See application file for complete search history.

(56) References Cited

U.S. PATENT DOCUMENTS

| | | | | | |
|---|---|---|---|---|---|
| 67,346 | A | | 7/1867 | Porter | |
| 201,093 | A | * | 3/1878 | Lazarus | 24/177 |
| 402,716 | A | * | 5/1889 | Buck | 248/37.6 |
| 591,668 | A | | 10/1897 | Johnson | |
| 773,345 | A | | 10/1904 | Scheidt | |
| 832,898 | A | * | 10/1906 | Fluehr | 215/390 |
| 882,636 | A | * | 3/1908 | Hopkins | 215/390 |
| 891,142 | A | * | 6/1908 | Bunnell | 248/37.6 |
| 1,226,304 | A | * | 5/1917 | Brumley | 215/306 |
| 1,265,263 | A | | 5/1918 | Sharpe | |
| 1,474,105 | A | | 11/1923 | Camp et al. | |
| 3,263,026 | A | * | 7/1966 | Kihs | 174/154 |
| 3,302,328 | A | * | 2/1967 | King | 47/47 |
| 3,504,108 | A | * | 3/1970 | Kihs | 174/154 |
| 3,513,842 | A | * | 5/1970 | Berg et al. | 602/60 |
| 3,883,934 | A | * | 5/1975 | Rochfort | 248/65 |
| 3,952,424 | A | * | 4/1976 | Herr et al. | 434/162 |
| D267,031 | S | * | 11/1982 | Hamlin | D22/147 |
| 4,657,243 | A | * | 4/1987 | Thomas | 482/47 |
| 4,893,788 | A | * | 1/1990 | Chave | 256/47 |
| 5,112,268 | A | * | 5/1992 | Klaus | 446/489 |
| D332,821 | S | * | 1/1993 | Padilla | D22/147 |
| 5,458,302 | A | * | 10/1995 | Volkoff | 248/107 |
| 5,490,650 | A | * | 2/1996 | Pendergrass | 248/220.31 |
| 6,802,480 | B1 | * | 10/2004 | Martello | 248/63 |
| 2003/0015487 | A1 | * | 1/2003 | Henderson et al. | 211/74 |

FOREIGN PATENT DOCUMENTS

| | | |
|---|---|---|
| DE | 535 325 | 9/1931 |
| DE | 41 19 804 A1 | 12/1992 |
| GB | 1 346 592 | 2/1974 |

* cited by examiner

*Primary Examiner*—Kimberly Wood
(74) *Attorney, Agent, or Firm*—Jack Lo

(57) ABSTRACT

A stopper holder for a beverage bottle is comprised of a first helical gripping member for positioning on the neck of the bottle, and a second helical member connected to the first gripping member for holding a stopper therein. The first and second helical gripping members are comprised of a continuous rod wherein the upper end of the first helical gripping member is connected to a lower end of the second helical gripping member by an integral connecting portion. Resilient cushions are positioned along the first helical gripping member for a snug fit on bottles of different sizes. The second helical gripping member is positioned above and to a side of the first helical gripping member for positioning the stopper away from the mouth of the bottle.

1 Claim, 2 Drawing Sheets

STOPPER HOLDER FOR BEVERAGE BOTTLE

CROSS REFERENCE TO RELATED APPLICATIONS

I claim the benefit of patent application number 29/200,581 filed on 1 Mar. 2004.

BACKGROUND OF THE INVENTION

1. Field of the Invention

The invention broadly relates to stopper holders for beverage bottles.

2. Prior Art

After a stopper such as a cork is removed from a beverage bottle, it may be placed on the table while the beverage is served from the bottle. However, the stopper may pick up food or other contaminants from the table, and it may become lost. Therefore, there are stopper holders that secure the stopper to the side of the bottle. However, some stopper holders are sized for a specific bottle, so they cannot be used on other bottles. Other stopper holders may fit different size bottles, but they fit loosely on smaller bottles, so they may fall off when the bottle is inverted during dispensing.

BRIEF SUMMARY OF THE INVENTION

A stopper holder for a beverage bottle is comprised of a first helical gripping member for positioning on the neck of the bottle, and a second helical member connected to the first gripping member for holding a stopper therein. The first and second helical gripping members are comprised of a continuous rod wherein the upper end of the first helical gripping member is connected to a lower end of the second helical gripping member by an integral connecting portion. Resilient cushions are positioned along the first helical gripping member for a snug fit on bottles of different sizes. The second helical gripping member is positioned above and to a side of the first helical gripping member for positioning the stopper away from the mouth of the bottle.

DRAWING REFERENCE NUMERALS

10. Stopper Holder
11. First Helical Gripping Member
12. Second Helical Gripping Member
13. Rod
14. Connecting Portion
15. Cushion
16. Bottle
17. Neck
18. Stopper
19. Ball
20. Hole

DETAILED DESCRIPTION OF THE INVENTION

FIGS. 1–3

Figure 1:
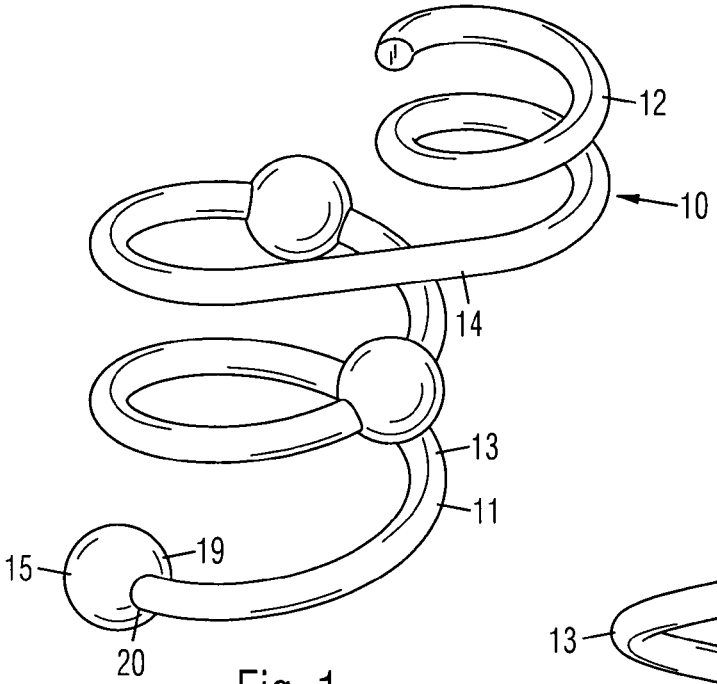
FIG. 1 is a front perspective view of the stopper holder.
Figure 2:
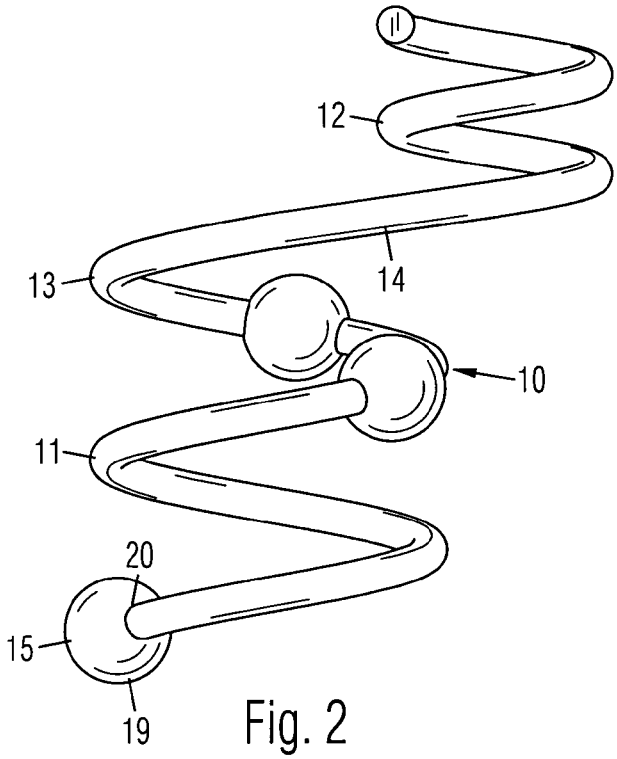
FIG. 2 is a front view thereof.
Figure 3:
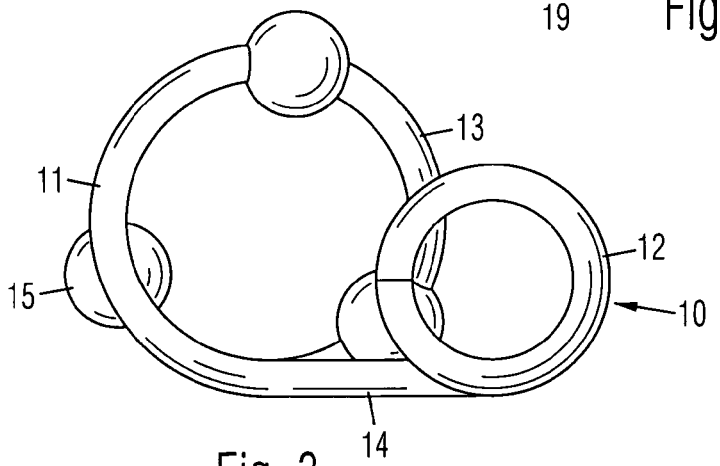
FIG. 3 is a top view thereof.

A preferred embodiment of a stopper holder 10 shown in FIGS. 1–3 is comprised of a first circular or helical gripping member 11, and a second circular or helical member 12 connected to first gripping member 11. First and second helical gripping members 11 and 12 are comprised of a single continuous rod 13 wherein the upper end of first helical gripping member 11 is connected to a lower end of second helical gripping member 12 by an integral connecting portion 14. Making first and second helical members 11 and 12 from a single rod enables economy of production. Cushions 15 are positioned along first helical gripping member 11, and are comprised of resilient balls 19 each with a hole 20 for being pushed onto first helical gripping member 11. Second helical gripping member 12 is positioned above and to a side of first helical gripping member 11.

FIGS. 4–5

Figure 4:
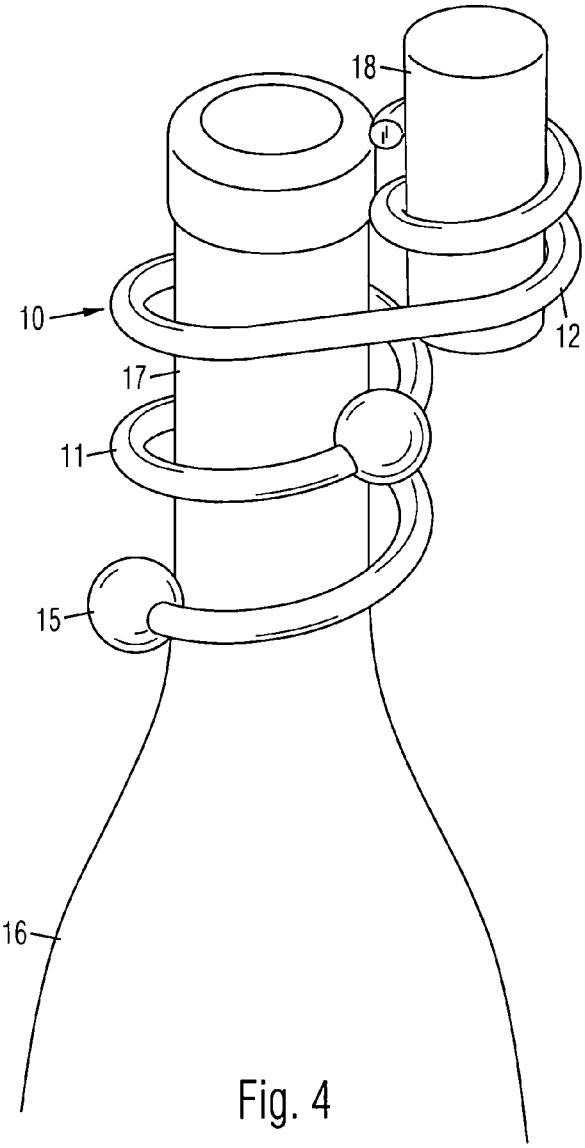
FIG. 4 is a front perspective view of the stopper holder on a bottle.
Figure 5:
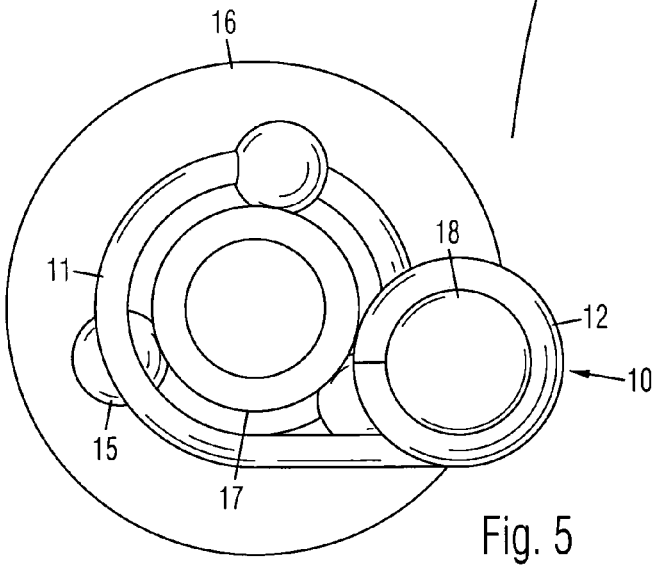
FIG. 5 is a top view thereof on the bottle.

Stopper holder 10 is shown in FIGS. 4–5 attached to a bottle 16, wherein first helical gripping member 11 is positioned around a neck 17 of a beverage bottle 16. First helical gripping member 11 and cushions 15 are sized for snugly gripping neck 17 to prevent stopper holder 10 from falling off when bottle 16 is inverted during serving. Cushions 15 are deformable for snugly fitting different size necks of different bottles. Second helical gripping member 12 is sized for snugly gripping a stopper 18 which has been removed from bottle 16, and positioning stopper 18 off to a side of neck 16. Bottle 16 may be any type of beverage bottle, and stopper 17 may be any type of device which closes bottle 16, such as a cork, a cap, etc.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

We claim:

1. A stopper holder for a beverage bottle, comprising:

a first helical gripping member comprising more than one turn about a first axis for positioning around a neck of said bottle;

a second helical gripping member comprising more than one turn about a second axis connected to said first gripping member for receiving a stopper removed from said bottle, wherein said first helical gripping member and said second helical gripping member are comprised of a single continuous rod, wherein an upper end of said first helical gripping member is connected to a lower end of said second helical gripping member by an integral connecting portion; and a deformable cushion positioned on said first helical gripping member for adapting to different size necks on different bottles, wherein said cushion is comprised of a resilient ball with a hole, wherein said first helical gripping member is positioned through in said hole.

* * * * *